United States Patent [19]

Wham et al.

[11] Patent Number: 4,648,345

[45] Date of Patent: Mar. 10, 1987

[54] PROPELLER SYSTEM WITH ELECTRONICALLY CONTROLLED CYCLIC AND COLLECTIVE BLADE PITCH

[75] Inventors: John L. Wham, San Diego; Lawrence A. Mackey, Santee, both of Calif.; Frederick R. Haselton, Cookeville, Tenn.

[73] Assignee: Ametek, Inc., El Cajon, Calif.

[21] Appl. No.: 774,565

[22] Filed: Sep. 10, 1985

[51] Int. Cl.[4] ..... B63G 8/16

[52] U.S. Cl. ..... 114/338; 440/50; 416/3; 416/155

[58] Field of Search ..... 114/338, 330, 126; 440/49, 50, 93; 416/155, 3, 98; 244/17.25

[56] References Cited

U.S. PATENT DOCUMENTS 3,101,066 8/1961 Haselton ..... 440/50 X

OTHER PUBLICATIONS

William G. Wilson, "Effects of Configurational Changes on Tandem Propeller Performance," Cornell Aeronautical Laboratory Report No. AG-1634-V-9, Feb. 1966.

Roy S. Rice, Jr., "Experimental Studies of Tandem Propeller Performance at Static Conditions," Cornell Aeronautical Laboratory Report No. AG-2381-K-2, Feb. 1968.

F. R. Haselton, "Tandem Propeller Tailoring Technique," Naval Engineers Journal, Aug. 1965, pp. 621-624.

J. Cantwell & S. Cap "Computer Mission Simulation for Parametric Design of Undersea Vehicles," IEEE Ocean '75, pp. 860-869.

F. R. Haselton "Tandem Propeller in Review," J. Hydronautics, vol. 3, No. 4, Oct. 1969, pp. 161, 163, 165, 167.

Richard S. Brannin, "Tandem Propellers", pp. 37-44.

*Primary Examiner*—Sherman D. Basinger
*Assistant Examiner*—Paul E. Salmon
*Attorney, Agent, or Firm*—Baker, Maxham & Jester

[57] ABSTRACT

A plurality of blades extend radially from a hub which is rotated by a motor about a drive axis. Each blade has a root which is rotatably connected to the hub so that it can be independently twisted to vary the pitch thereof relative to the drive axis. A plurality of electromagnets are annularly positioned adjacent the hub so that permanent magnets connected to the roots of corresponding blades can be attracted and/or repelled to induce twisting motion in the blades as the hub rotates about its drive axis. A control circuit receives input commands for a manual control device and causes predetermined electrical signals to be applied to the electromagnets for simultaneously varying the pitch of the blades. The pitch of the blades can be varied cyclically and collectively in accordance with any real continuous function, and not just sinusoidally as in the case of prior mechanical linkages employing swash plates. A vessel equipped with the propeller system at the fore and aft ends thereof can be precisely maneuvered in six degrees of freedom.

32 Claims, 6 Drawing Figures

PROPELLER SYSTEM WITH ELECTRONICALLY CONTROLLED CYCLIC AND COLLECTIVE BLADE PITCH

BACKGROUND OF THE INVENTION

The present invention relates to impeller type propulsion systems, and more particularly, to a propeller system adapted for precision control of a submersible vehicle in six different degrees of freedom.

There are many uses for an unmanned (remotely piloted) deep submersible ocean vehicle such as maintenance and repair of underwater oil well facilities, location and recovery of sunken aircraft and underwater surveying. Commands and sensor data from cameras and other on-board instrumentation may be transmitted to and from the vehicle via a tether or sonar. Such a deep submersible vehicle must be capable of a high degree of maneuverability and precision control in a reliable manner in order to effectively accomplish such tasks. In particular, such a submersible vehicle must be able to make precise translational and rotational movements relative to the surge (fore-aft), sway (athwartship), and heave (vertical) axes. Such a vehicle must also be capable of maintaining any attitude to perform its tasks, and it must be able to exert large forces and moments with precision.

Heretofore remotely piloted deep submersible vehicles for performing this type of work have typically included a frame or sled with a viewing camera, lights, robot arms and a plurality of outboard thrusters for movement relative to the three different axes. These thrusters have typically been hydraulic and have required complex control mechanisms. The efficiency and response time of such thrusters and their ability to accomplish precision maneuvers are limited.

In U.S. Pat. No. 3,101,066 of Haselton there is disclosed a submarine with fore and aft counter-rotating propellers, and mechanisms for controlling the cyclical and collective pitch of the blades of each of the propellers independently for maneuvering the vehicle in six degrees of freedom. Mechanisms which have heretofore existed for accomplishing cyclic and collective pitch control have typically been complex mechanical arrangements similar to the swash plate mechanisms in helicopters. Such mechanisms require a great deal of maintenance and are therefore unsuitable for submarine use. In addition, they can only change blade pitch sinusoidally, i.e. the blade angle alpha varies as a sinusoidal function of the angular position theta of the blade relative to the rotational axis of the propeller, owing to the geometry involved in a swash plate mechanism. This imposes a limitation on the ability to achieve precise maneuvers.

SUMMARY OF THE INVENTION

It is the primary object of the present invention to provide an improved system for varying the pitch angle of the blades of a propeller during rotation thereof.

It is another object of the present invention to provide an improved system for varying the pitch angle of a plurality of blades of a propeller both cyclically and collectively.

It is another object of the present invention to provide a system for varying the pitch angle of a plurality of blades of a propeller both cyclically and collectively in a non-sinusoidal manner.

It is another object of the present invention to provide a system for controlling the cyclic and collective pitch of the blades of a propeller without any swash plate or other mechanical linkages between the blades and the control.

It is another object of the present invention to provide an electronic control system for simultaneously varying the pitch of a plurality of blades of a propeller both cyclically and collectively.

It is another object of the present invention to provide an improved propulsion system for precision maneuvering a submersible vehicle in six degrees of freedom.

According to the illustrated embodiment of the present invention, a plurality of blades extend radially from a hub which is rotated by a motor about a drive axis. Each blade has a root which is rotatably connected to the hub so that it can be independently twisted to vary the pitch thereof relative to the drive axis. A plurality of electromagnets are annularly positioned adjacent the hub so that permanent magnets connected to the roots of corresponding blades can be attracted and/or repelled to induce twisting motion in the blades as the hub rotates about its drive axis. A control circuit receives input commands for a manual control device and causes predetermined electrical signals to be applied to the electromagnets for simultaneously varying the pitch of the blades. The pitch of the blades can be varied cyclically and collectively in accordance with any real continuous function, and not just sinusoidally as in the case of prior mechanical linkages employing swash plates. A vessel equipped with the propeller system at the fore and aft ends thereof can be precisely maneuvered in six degrees of freedom.

DESCRIPTION OF THE PREFERRED EMBODIMENT

The entire dislosure of U.S. Pat. No. 3,101,066 of Haselton is incorporated herein by reference.

Figure 1:
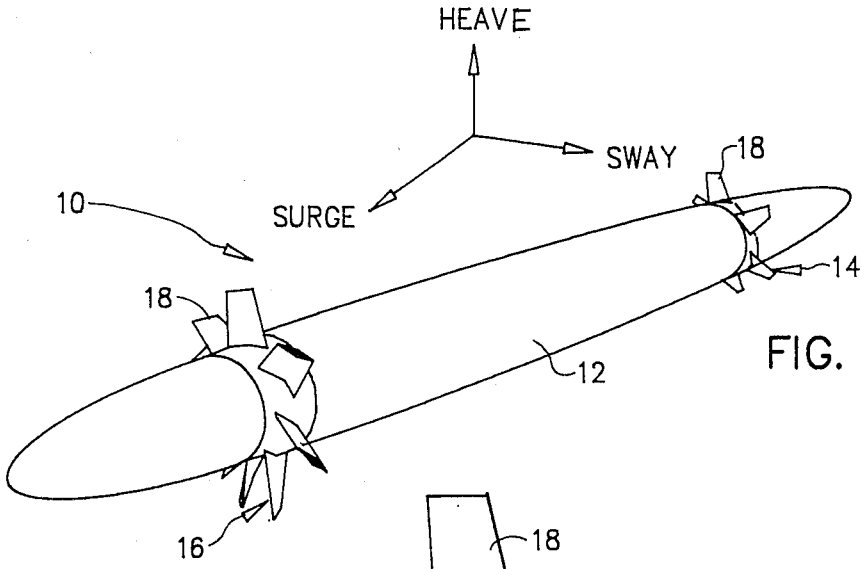
FIG. 1 is a perspective view of a submersible vessel equipped with the propeller system of the present invention at the fore and aft ends thereof.

Referring to FIG. 1 a submersible vessel 10 has a streamlined elongate hull 12 which is tapered at its fore and aft ends. Propellers 14 and 16 are mounted adjacent the fore and aft ends of the hull, respectively, with their rotational drive axes coincident with the central longitudinal axis of the hull. Each of the propellers has six radially extending, circumferentially spaced variable pitch blades 18. The cyclic and collective pitch the blades on each of the propellers may be independently varied to precisely maneuver the vessel in six degrees of freedom. These include translational and rotational movement relative to the illustrated surge (fore-aft), sway (athwartship), and heave (vertical) axes. The vessel is thus propelled and steered via the twin propellers 14 and 16 and no rudders are required.

Figure 2:
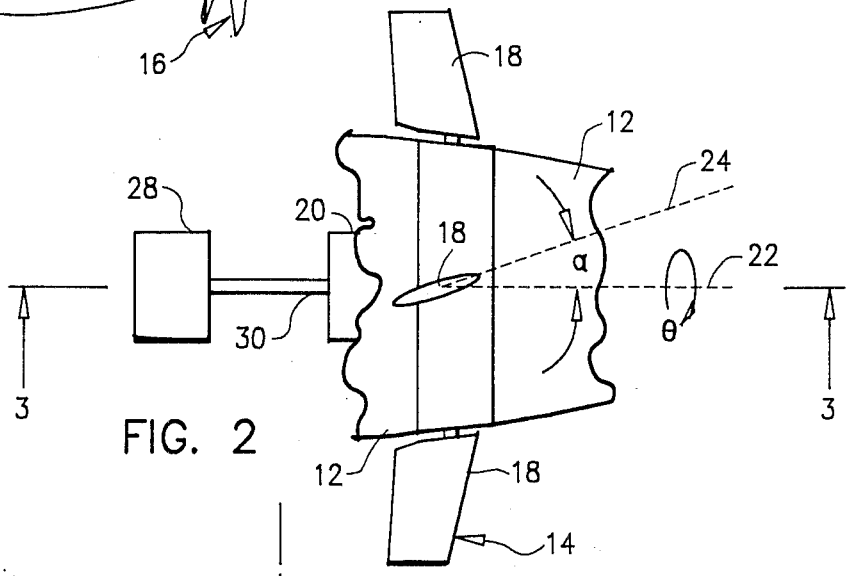
FIG. 2 is an enlarged, fragmentary side elevation view of the propeller and drive motor at the fore end of the vessel.
Figure 3:
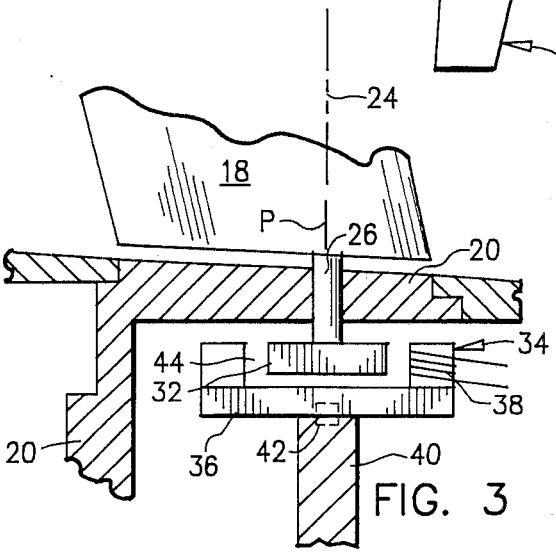
FIG. 3 is a further enlarged fragmentary side elevation view illustrating a portion of the propeller of FIG. 2 with its pitch variation mechanisms.

Referring to FIG. 2, each of the propellers such as 14 is driven and controlled by similar mechanisms. A hub 20 for supports the blades 18 for rotation about a common drive axis 22 illustrated in phantom lines and for permits the blades to be twisted about corresponding blade axes such as 24 (FIG. 3). The root of each blade is connected to a corresponding shaft 26 which extends radially through a hole in the hub and is journaled therein with suitable bearings (not illustrated) to permit free rotation of the blade. The peripheral portion of the hub 20 interfaces with the hull 12 so as to function as a streamlined continuation of the hull while permitting relative rotation therebetween. As is conventional, the vessel 10 may have means not illustrated for permitting water to be pumped in and out of portions of the hull for buoyancy control. Hub 20 may be provided with various seals and housings readily apparent to one skilled in the art in order to prevent sea water from contacting the variable blade pitch mechanisms hereafter described.

Figure 5:
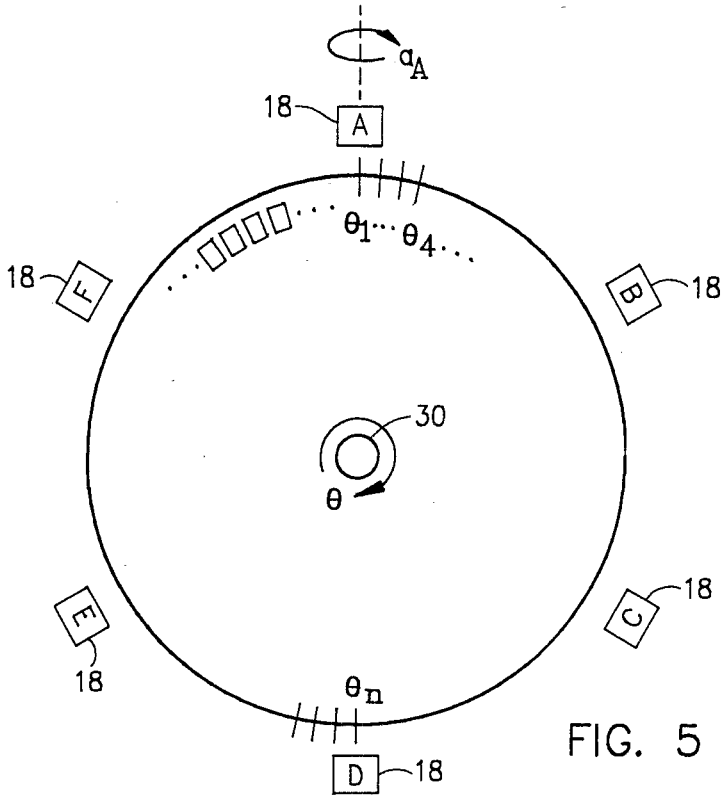
FIG. 5 is a diagrammatic illustration of the manner in which the position of each of the blades on the propeller is used in cyclic and collective blade pitch control.

Referring again to FIG. 2, each of the blades 18 is slightly inclined in the aft direction so that there is an acute angle between the leading and trailing edges of each blade and its axis 24. There is also an acute angle between each of the blades and the drive axis 22. An electric, hydraulic or other motor 28 is drivingly connected to the hub 20 via drive shaft 30. Each blade preferrably has an airfoil cross-section and is configured so that the center of fluid pressure P on the blade (FIG. 3) coincides with the twist axis 24 of the blade. This minimizes the amount of spindle torque required to twist the blade during submerged rotation of the propeller 14. Referring to FIGS. 2 and 5, the pitch of each blade with respect to the drive axis 22 of the propeller is designated by the angle alpha. The position of the individual blades about the drive axis 22 as the propeller rotates is designated by the angle theta.

Figure 4:
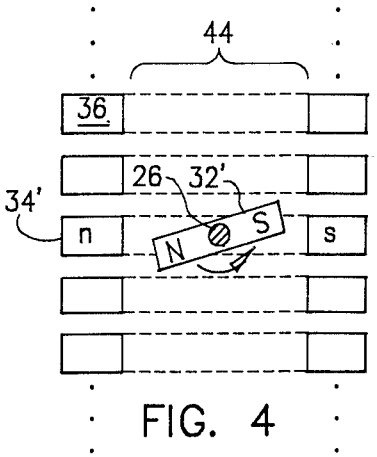
FIG. 4 is a diagrammatic illustration of the relationship of the plurality of electromagnets and the permanent magnet connected to the root of each blade.

Referring to FIG. 3, a permanent magnet such as 32 is rigidly connected to the inner end the shaft 26 of each of the blades 18. A plurality of stationary electromagnets 34 are positioned inside the hub 20 for inducing motion of the permanent magnets as the hub rotates to thereby permit the pitch of the blades to be cyclically and collectively controlled without any direct mechanical connection to the blades. Each electromagnet 34 includes a generally U-shaped metal element 36 defining a pair of longitudinally spaced poles whose strength and polarization (North or South) may be controlled by applying predetermined electrical signals to a coil 38 wound about a segment of the metal element 36. As illustrated in FIGS. 3 and 4, the U-shaped metal elements 36 of the plurality of electromagnets are secured at annularly spaced locations about the peripheral edge of a stationary supporting disk 40 via fasteners 42. As illustrated in FIG. 4, the U-shaped metal elements 36 are parallel and closely spaced to define a radially outwardly opening channel 44 in which the permanent magnets travel during rotation of the hub 20 as illustrated in FIG. 3. Referring again to FIG. 4, and by way of example, the coil on a given electromagnet 34' may be energized to generate poles n and s of predetermined magnetic strength which repel the poles N and S of the immediately adjacent permanent magnet 32'. Clearly only one of the poles of the permanent magnet need be attracted or repelled to twist the blade 18, however by affecting both poles greater spindle torque can be generated. It is also clear that the four electromagnets immediately adjacent to the electromagnet 34' in FIG. 4 can be energized to further increase the spindle torque on the blade 18 attached to the permanent magnet 32' when that permanent magnet is in its instantaneous rotational position illustrated in FIG. 4.

Figure 6:
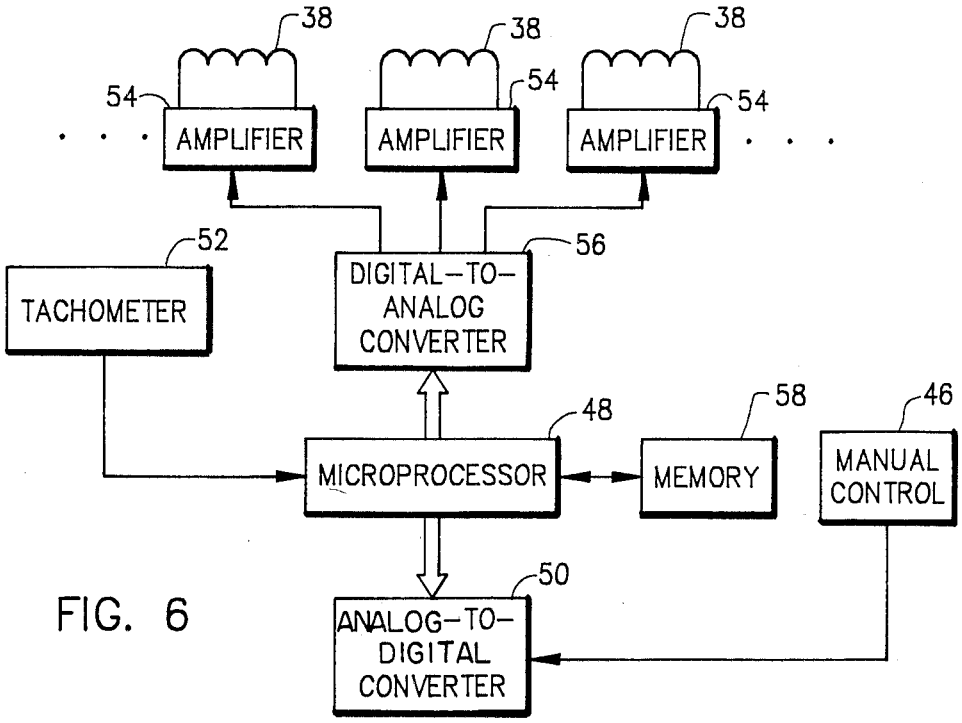
FIG. 6 is a block diagram of the control circuit of the preferred embodiment of the propeller system.

Referring to FIG. 6, a control circuit for simultaneous independent control of the pitch of the blades 18 is illustrated in block diagram form. Analog signals representative of maneuvering commands are generated by manual actuation of a set of control devices 46 such as joy sticks and control knobs. These analog signals are fed to a microprocessor 48 via analog-to-digital converter 50. A tachometer or other sensor device 52 proximate the hub 20 or drive shaft 30 sends digital signals to the microprocessor 48 representative of the angular position of each of the six blades 18 about the drive axis. For example, a certain pulse count may indicate that blade A (FIG. 5) is at position theta sub 1, blade D is at position theta sub n and so forth. All six blades, namely A–F, of the propeller 14 are illustrated diagrammatically in FIG. 5. The coils 38 (FIG. 6) of each of the electromagnets are connected to corresponding amplifiers 54 which are in turn connected to the microprocessor 48 via digital-to-analog converter 56. Using a program stored in memory 58 the microprocessor causes predetermined currents to be applied to the selected ones of the coils 38 for the appropriated time intervals so that the electromagnets adjacent the permanent magnets 32 connected to each of the six propeller blades 18 will be moved the appropriate amounts to thereby provide the particular cyclic and collective pitch control required to maneuver the vessel in accordance with the commands inputted via manual controls 46. The microprocessor "knows" the angular position theta of each of the blades A–F around the drive axis 22 at any given instant of time from the output of the tachometer 52 and therefore "knows" which of the electromagnets to energize and in what polarities and amounts to produce the desired different pitches alpha sub A through alpha sub F at any given instant to achieve the commanded maneuver.

By way of example, the amplifiers 54 may include FET "SMART POWER" devices. There may be three-hundred and sixty electromagnets 34 to ensure an adequate precision in pitch control. Five electromagnets may be energized simultaneously adjacent any given instantaneous position of a given blade. Thus, where there are a total of three-hundred electromagnets, only thirty may be energized at any particular instant. In a typical unmanned submersible vessel the propeller 14 may rotate at a relatively slow speed of one-hundred and eighty RPM. Microprocessors are commercially available that operate at extremely high speeds, such as one megahertz. In the foregoing example it would take roughly two milliseconds for one of the permanent magnets to travel the distance between two adjacent electromagnets. In this time the microprocessor could do roughly two thousand floating point operations. This is more than enough computing capability to enable the microprocessor to calculate and apply the next set of currents that must be applied to next successive set of thirty electromagnets before the blades have traveled a circumferential distance equal to that separating successive blades. The control circuit of FIG. 6 can simultaneously control the electromagnets of both the fore and aft propellers 14 and 16 to enable rapid response time maneuvering of the vessel 10 in six degrees of freedom. In contrast to prior cyclic and collective pitch control systems which have employed complex mechanical linkages employing swash plates, our invention permits the pitch control to be accomplished in accordance with non-sinusoidal as well as sinusoidal functions. If cyclic and collective pitch is limited to sinusoidal control then the vessel would lose its capability to be independently maneuvered with respect to the three control axes, i.e. surge, sway and heave. The blades control function may be defined so as to extend over more than one revolution of the hub or over a partial revolution. Since the means for inducing twisting motion in the blades have no direct mechanical connection to the blades response time is very rapid, weight and complexity are reduced, and reliability is greatly increased. With our system it is possible, for example, to achieve athwartship and vertical thrust which are a large percentage of the achievable fore-aft thrust. For example, the vessel 10 could achieve one-thousand pounds of surge thrust and five-hundred pounds of sway and/or heave thrust. A simple inexpensive electric motor may rotate the hubs a constant uniform velocity with pitch being varied for speed and directional control. Because the multiple outboard thrusters are eliminated the vessel is lighter and more maneuverable than existing unmanned submersible vessels. For example, the vessel can attach a single robot arm to a bolt, move the arm to tighten the bolt while the torque is immediately countered with a specific propeller thrust.

Details of the cyclic and collective pitch control required to maneuver in the six degrees of freedom are well known to persons skilled in the art. See for example "Effects of Configurational Changes on Tandem Propeller Performance" by William G. Wilson dated February, 1966 and prepared for the Office of Naval Research Mathematical Sciences Division, Department of the Navy, CAL Report No. AG-1634-V-9. See also "Experimental Studies of Tandem Propeller Performance at Static Conditions" by Roy S. Rice, Jr. dated Feb. 2, 1968 and prepared for the Department of the Navy, Naval Ship Systems Command, CAL Report No. AG-2381-K-2.

Having described a preferred embodiment of our propeller system, it should be understood that modifications and adaptations of our invention will occur to those skilled in the art. For example, the separate drive motor 28 could be eliminated and the hub rotated by coordinated energization of the electromagnets. A vernier state sequencer controller could be used to precisely control the transitional phase between successive sets of five electromagnets. Therefore, the protection afforded our invention should only be limited in accordance with the scope of the following claims.

We claim:

1. A propeller system, comprising:

a plurality of blades;

hub means for supporting the blades for rotation about a common drive axis and so that each blade can be independently twisted about a corresponding blade axis to vary the pitch of the blade relative to the drive axis; and means for rotating the hub means about the drive axis and for twisting the blades to non-sinusoidally vary a cyclic pitch and a collective pitch of the blades during rotation of the hub means, including a plurality of permanent magnets, each rigidly connected to a root of a corresponding blade.

2. A propeller system according to claim 1 wherein the hub rotating and pitch varying means further includes a plurality of electromagnets for inducing motion of the permanent magnets to thereby twist the blades when electrical signals are applied to the electromagnets.

3. A propeller system according to claim 2 wherein the hub rotating and pitch varying means further includes control means for generating the electrical signals in response to a set of commands inputted thereto.

4. A propeller system according to claim 3 wherein the control means includes at least one manual control device for generating analog electrical signals representative of the set of commands inputted by manual actuation of the control device, a digital processor, a memory connected to the processor for storing a control program, an analog-to-digital converter operatively connecting the manual control device and the processor, a plurality of amplifiers each operatively connected to a corresponding one of the electromagnets for energizing the same, a sensor for inputting an electrical signal to the processor representative of an angular position of the hub means relative to the drive axis, and a digital-to-analog converter operatively connecting the processor and the amplifiers for allowing the processor to cause predetermined electrical signals to be applied to the amplifiers in accordance with the inputted commands, the angular position signal and the control program.

5. A propeller system according to claim 2 wherein the rotation of the hub means is accomplished by coordinated energization of the electromagnets.

6. A propeller system according to claim 2 wherein each electromagnet has a generally U-shaped configuration and the plurality of electromagnets define a radially outwardly opening channel in which the permanent magnets rotate.

7. A propeller system according to claim 1 wherein the hub rotating and pitch varying means further includes motor means for rotating the hub means about the drive axis.

8. A propeller system according to claim 1 wherein each blade is configured so that a center of fluid pressure generated on each blade substantially coincides with the corresponding blade axis of the blade.

9. A propeller system according to claim 1 wherein the blades extend at an acute angle relative to the drive axis.

10. A propeller system, comprising:

a plurality of blades;

hub means for supporting the blades for rotation about a common drive axis and so that each blade can be indpendently twisted about a corresponding blade axis to vary the pitch of the blade relative to the drive axis; and means for rotating the hub means about the drive axis and for twisting the blades to vary a cyclic pitch and a collective pitch of the blades during rotation of the hub means, including a plurality of permanent magnets, each rigidly connected to a root of a corresponding blade.

11. A propeller system according to claim 10 wherein the hub rotating and pitch varying means further includes a plurality of electromagnets for inducing motion of the permanant magnets to thereby twist the blades when electrical signals are applied to the electromagnets.

12. A propeller system according to claim 11 wherein the hub rotating and pitch varying means further includes control means for generating the electrical signals in response to a set of commands inputted thereto.

13. A propeller system according to claim 12 wherein the control means includes at least one manual control device for generating analog electrical signals representative of the set of commands inputted by manual actuation of the control device, a digital processor, a memory connected to the processor for storing a control program, an analog-to-digital converter operatively connecting the manual control device and the processor, a plurality of amplifiers each operatively connected to a corresponding one of the electromagnets for energizing the same, a sensor for inputting an electrical signal to the processor representative of an angular position of the hub means relative to the drive axis, and a digital-to-analog converter operatively connecting the processor and the amplifiers for allowing the processor to cause predetermined electrical signals to be applied to the amplifiers in accordance with the inputted commands, the angular position signal and the control program.

14. A propeller system according to claim 11 wherein the rotation of the hub means is accomplished by coordinated energization of the electromagnets.

15. A propeller system according to claim 11 wherein each electromagnet has a generally U-shaped configuration and the plurality of electromagnets define a radially outwardly opening channel in which the permanent magnets rotate.

16. A propeller system according to claim 10 wherein the hub rotating and pitch varying means further includes motor means for rotating the hub means about the drive axis.

17. A propeller system according to claim 10 wherein each blade is configured so that a center of fluid pressure generated on each blade substantially coincides with the corresponding blade axis of the blade.

18. A propeller system according to claim 10 wherein the blades extend at an acute angle relative to the drive axis.

19. A submersible vessel, comprising:

an elongate hull;

a first propeller mounted adjacent a fore end of the hull for rotation about a longitudinal axis of the hull;

a second propeller mounted adjacent an aft end of the hull for rotation about the longitudinal axis of the hull;

each of the propellers including a plurality of blades and hub means for supporting the blades for rotation about a common drive axis and so that each blade can be independently twisted about a corresponding blade axis to vary the pitch of the blade relative to the drive axis; and means for rotating the hub means of the first and second propellers about the longitudinal axis and for varying a cyclic pitch and a collective pitch of the blades during rotation of the hub means for maneuvering the hull in six different degrees of freedom, including a plurality of permanent magnets, each rigidly connected to a root of a corresponding blade.

20. A submersible vessel according to claim 19 wherein the hub rotating and pitch varying means further includes a plurality of electromagnets for inducing motion of the permanent magnets to thereby twist the blades when electrical signals are applied to the electromagnets.

21. A submersible vessel according to claim 20 wherein the hub rotating and pitch varying means further includes control means for generating the electrical signals in response to a set of commands inputted thereto.

22. A submersible vessel according to claim 21 wherein the control means includes at least one manual control device for generating analog electrical signals representative of the set of commands inputted by manual actuation of the control device, a digital processor, a memory connected to the processor for storing a control program, an analog-to-digital converter operatively connecting the manual control device and the processor, a plurality of amplifiers each operatively connected to a corresponding one of the electromagnets for energizing the same, a sensor for inputting an electrical signal to the processor representative of an angular position of the hub means relative to the drive axis, and a digital-to-analog converter operatively connecting the processor and the amplifiers for allowing the processor to cause predetermined electrical signals to be applied to the amplifiers in accordance with the inputted commands, the angular position signal and the control program.

23. A submersible vessel according to claim 20 wherein the rotation of the hub means is accomplished by coordinated energization of the electromagnets.

24. A submersible vessel according to claim 20 wherein each electromagnet has a generally U-shaped configuration and the plurality of electromagnets define a radially outwardly opening channel in which the permanent magnets rotate.

25. A submersible vessel according to claim 19 wherein tne hub rotating and pitch varying means further includes motor means for rotating the hub means about the longitudinal axis.

26. A submersible vessel according to claim 19 wherein each blade is configured so that a center of fluid pressure generated on each blade substantially coincides with the corresponding blade axis of the blade.

27. A submersible vessel according to claim 19 the blades extend at an acute angle relative to the drive axis.

28. A propeller system, comprising:

a plurality of blades each having a root;

means for supporting the blades for rotation about a common drive axis and so that each blade can be independently twisted about a corresponding blade axis to vary the pitch thereof relative to the drive axis;

means for rotating the blade supporting means about the drive axis; and means for twisting the blades during rotation of the blade supporting means to independently vary a cyclic pitch of the blades and a collective pitch of the blades during rotation of the blade supporting means about the drive axis, including a plurality of electromagnets annularly spaced about the drive axis radially inward of roots of the blades, each electromagnet being capable of being energized to attract or repel a member rigidly connected to a root of a selected blade to generate a torque on the selected blade about its blade axis as the selected blade moves past the energized electromagnet.

29. A propeller system, comprising:

a plurality of blades each having a root;

means for supporting the blades for rotation about a common drive axis and so that each blade can be independently twisted about a corresponding blade axis to vary the pitch thereof relative to the drive axis;

means for rotating the blade supporting means about the drive axis; and means for twisting the blades during rotation of the blade supporting means to independently vary a cyclic pitch of the blades and a collective pitch of the blades during rotation of the blade supporting means about the drive axis, including a plurality of electromagnetic means spaced annularly about the drive axis adjacent the roots of the blades for each generating a predetermined torque on a selected blade as it moves thereby.

30. A propeller system according to claim 29 and further comprising at least one manual control device for generating analog electrical signals representative of a set of commands inputted by manual actuation of the control device, a digital processor, a memory connected to the processor for storing a control program, an analog-to-digital converter operatively connecting the manual control device and the processor, a plurality of amplifiers each operatively connected to a corresponding one of the electromagnetic means, a sensor for inputting an electrical signal to the processor representative of an annular position of the blade supporting means relative to the drive axis, and a digital-to-analog converter operatively connecting the processor and the amplifiers for allowing the processor to cause predetermined electrical signals to be applied to the amplifiers in accordance with the inputted commands, the angular position signal and the control program.

31. A propeller system, comprising:

a plurality of blades;

a generally cylindrical hub;

means for supporting the hub for rotation about a drive axis;

a plurality of shafts, each having an outer end rigidly connected to a root of a corresponding blade to define a blade axis, the shafts extending radially through the hub at circumferentially spaced locations around the hub and being rotatable to twist the blades about their blade axis;

a plurality of permanent magnets, each rigidly attached to an inner end of a corresponding shaft;

a plurality of electromagnets; and means for supporting the electromagnets in annularly spaced relationship about the drive axis radially inward of the permanent magnets, each electromagnet being capable of being energized to induce motion of an adjacent permanent magnet to thereby twist the blade connected thereto as the blades rotate about the drive axis.

32. A propeller system, comprising:

a plurality of blades;

means for supporting the blades for rotation about a common drive axis and to that each can be independently twisted about a corresponding blade axis to vary the pitch thereof relative to the drive axis;

a plurality of electromagnetic means positioned in a plurality of fixed locations annularly spaced about the drive axis adjacent the roots of the blades, each being separately energizable to generate a torque or a selected blade as it moves thereby; and control means for energizing the electromagnets in a coordinated manner to cause the blade supported means to rotate about the drive axis and to independently vary a cyclic pitch of the blades and a collective pitch of the blades as the blade supporting means rotates about the drive axis.

* * * * *